US010201240B1

(12) United States Patent
Arrighi

(10) Patent No.: US 10,201,240 B1
(45) Date of Patent: Feb. 12, 2019

(54) HEADREST

(71) Applicant: Chandler A. Arrighi, Sacramento, CA (US)

(72) Inventor: Chandler A. Arrighi, Sacramento, CA (US)

( * ) Notice: Subject to any disclaimer, the term of this patent is extended or adjusted under 35 U.S.C. 154(b) by 304 days.

(21) Appl. No.: 15/270,198

(22) Filed: Sep. 20, 2016

(51) Int. Cl.

| | |
|---|---|
| ***A47G 9/10*** | (2006.01) |
| ***A47C 20/02*** | (2006.01) |
| ***A61G 13/12*** | (2006.01) |
| ***A61G 7/07*** | (2006.01) |
| *A47G 9/00* | (2006.01) |

(52) U.S. Cl.
CPC ..... *A47G 9/1054* (2013.01); *A47C 20/026* (2013.01); *A47G 9/1036* (2013.01); *A47G 9/1045* (2013.01); *A61G 7/072* (2013.01); *A61G 13/121* (2013.01); *A47G 2009/006* (2013.01); *A47G 2200/143* (2013.01)

(58) Field of Classification Search
CPC .... A61G 7/072; A61G 13/121; A47C 20/026; A47G 9/1036; A47G 9/1045; A47G 9/1054; A47G 2200/14; A47G 2200/143; A47G 2009/006
See application file for complete search history.

(56) References Cited

U.S. PATENT DOCUMENTS 2,239,003 A * 4/1941 Jones ..... A47G 9/1009 5/638
3,315,282 A * 4/1967 Lowery ..... A47G 9/1054 132/212
3,366,106 A 1/1968 Yao
5,865,181 A * 2/1999 Spence, Jr. ..... A61G 13/12 128/845
5,946,749 A * 9/1999 Sewell ..... A47C 1/143 297/188.08
5,970,546 A * 10/1999 Danis ..... A47C 20/026 5/636
6,023,801 A * 2/2000 Lamm ..... A47G 9/1009 5/636
6,397,414 B1 * 6/2002 Lloyd ..... A47C 20/026 297/900
6,718,581 B2 * 4/2004 Riach ..... A61B 6/0421 5/607
6,721,978 B1 4/2004 Tankersley
6,857,149 B2 * 2/2005 Hoggatt ..... A47C 20/026 5/632
7,036,168 B1 * 5/2006 Knickerbocker ..... A47G 9/10 5/636
7,089,613 B2 * 8/2006 Cohen ..... A47C 20/026 5/622
7,426,763 B2 * 9/2008 Mazzei ..... A61G 13/12 5/622
7,694,370 B1 * 4/2010 Lee ..... A61G 13/009 5/622

(Continued)

*Primary Examiner* — Robert G Santos
*Assistant Examiner* — David R Hare

(57) ABSTRACT

The headrest is a table top pillow. The headrest is self-supporting structure that supports the head of a user in such a manner that a user may lie face down in the headrest. The headrest provides support for the face of the user. The headrest incorporates passages that allow for breathing while lying face down. The headrest is suitable for domestic and medical uses. The headrest comprises a base, a first pad, and a second pad. The first pad and the second pad are mounted on the base.

13 Claims, 4 Drawing Sheets

(56) References Cited

U.S. PATENT DOCUMENTS

| | | | | |
|---|---|---|---|---|
| 7,997,276 | B2 * | 8/2011 | Goff | A61F 5/56 128/845 |
| 8,011,731 | B2 | 9/2011 | Goddu | |
| 8,056,166 | B2 * | 11/2011 | Calvert | A47G 9/1009 5/636 |
| 8,468,628 | B1 * | 6/2013 | Cheng | A47G 9/007 5/632 |
| 8,474,079 | B1 * | 7/2013 | Gangitano | A47C 21/048 5/421 |
| 8,549,683 | B2 * | 10/2013 | Ratner | A61G 13/121 128/845 |
| 8,752,221 | B2 * | 6/2014 | Ortega | A47C 27/081 5/630 |
| 8,850,642 | B2 * | 10/2014 | Rasmussen | A47G 9/1027 297/398 |
| 9,084,494 | B2 * | 7/2015 | Riach | A47C 20/026 |
| 9,226,587 | B2 | 1/2016 | Halimi et al. | |
| 9,308,147 | B2 * | 4/2016 | Davis | A61G 7/07 |
| 9,457,904 | B1 * | 10/2016 | Fey | B64D 11/0638 |
| 9,877,588 | B2 * | 1/2018 | Belleh | A47C 16/00 |
| 2005/0177946 | A1 * | 8/2005 | Riley | A47G 9/1009 5/638 |
| 2006/0053556 | A1 * | 3/2006 | Piontek | A61F 5/3707 5/637 |
| 2010/0319706 | A1 * | 12/2010 | Berry | A61G 13/12 128/845 |
| 2014/0100490 | A1 * | 4/2014 | Chelgren | A61H 37/00 601/24 |

* cited by examiner

HEADREST

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal or domestic articles including furniture, more specifically, a standalone rest or support for the head.

SUMMARY OF INVENTION

The headrest is a table top pillow. The headrest is self-supporting structure that supports the head of a user in such a manner that a user may lie face down in the headrest. The headrest provides support for the face of the user. The headrest incorporates passages that allow for breathing while lying face down. The headrest is suitable for domestic and medical uses.

These together with additional objects, features and advantages of the headrest will be readily apparent to those of ordinary skill in the art upon reading the following detailed description of the presently preferred, but nonetheless illustrative, embodiments when taken in conjunction with the accompanying drawings.

In this respect, before explaining the current embodiments of the headrest in detail, it is to be understood that the headrest is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the headrest.

It is therefore important that the claims be regarded as including such equivalent construction insofar as they do not depart from the spirit and scope of the headrest. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
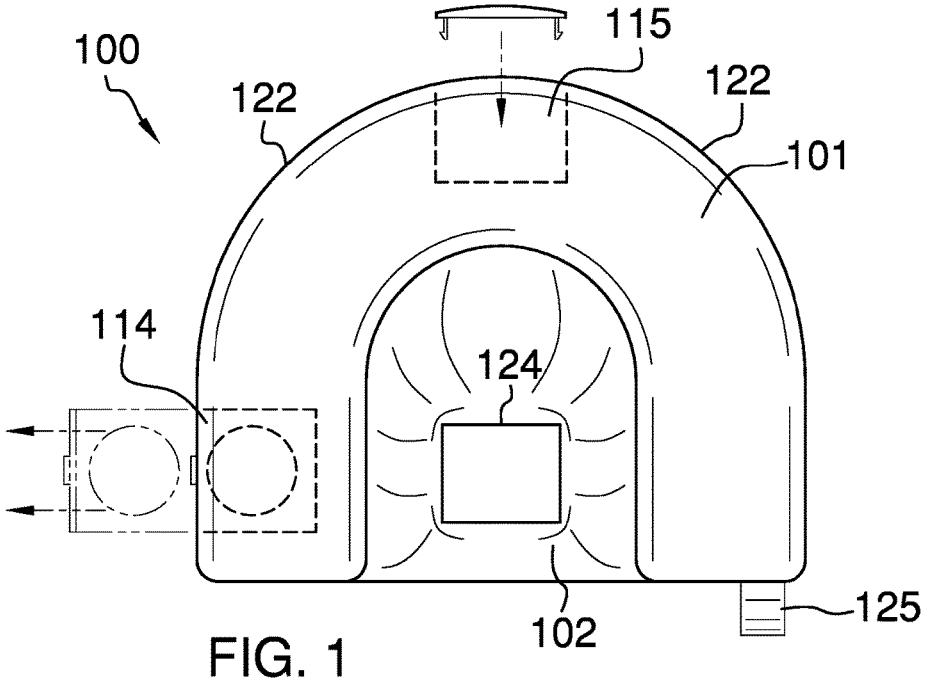
FIG. 1 is a top view of an embodiment of the disclosure.
Figure 2:
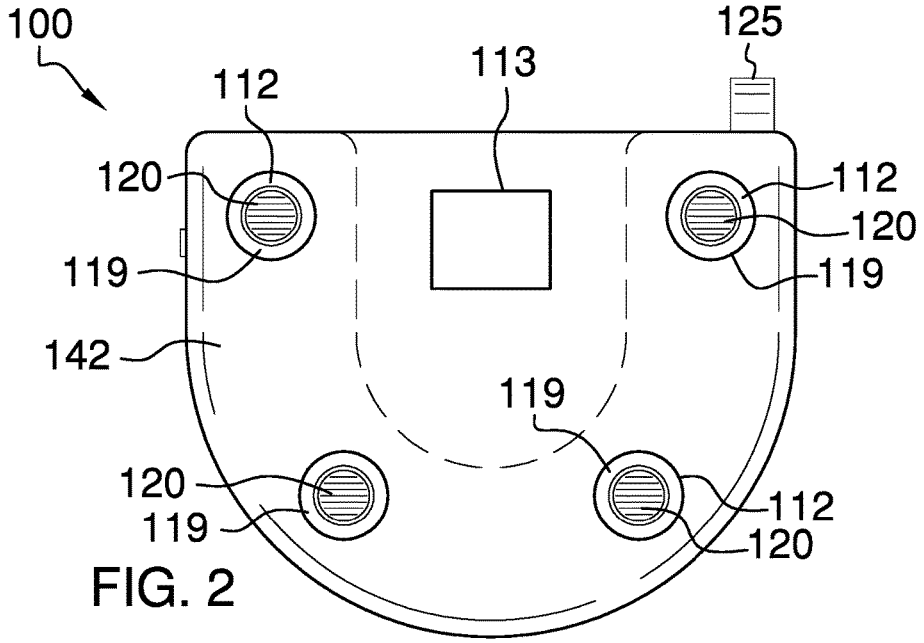
FIG. 2 is a bottom view of an embodiment of the disclosure.
Figure 3:
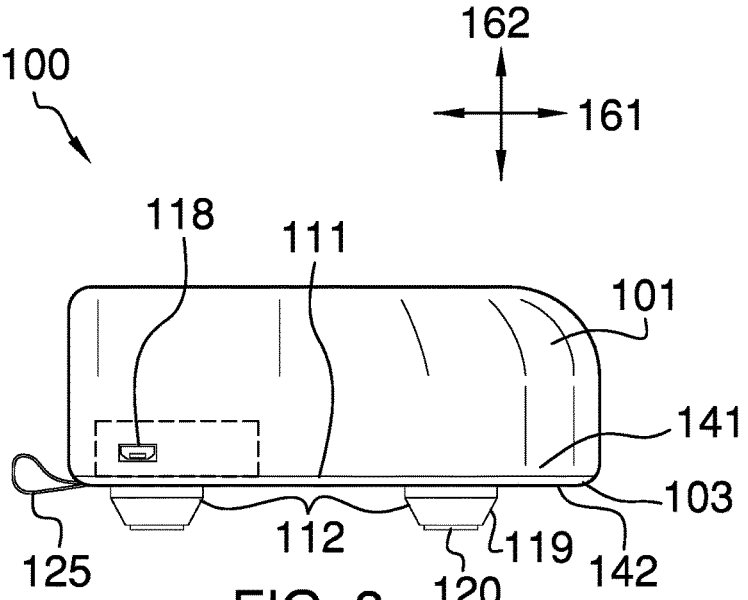
FIG. 3 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 7.

The headrest 100 (hereinafter invention) comprises a base 103, a first pad 101, and a second pad 102. The first pad 101 and the second pad 102 are mounted on the base 103. The invention 100 is a table top pillow. The invention 100 is self-supporting structure that supports the head 172 of a user 171 in such a manner that the head 172 of the user 171 may lie face down in the invention 100. The invention 100 is used on a horizontal 161 surface 163. The invention 100 provides support for the head 172 of the user 171. The invention 100 incorporates passages that allows for breathing while lying face down. The invention 100 is suitable for domestic and medical uses.

Figure 4:
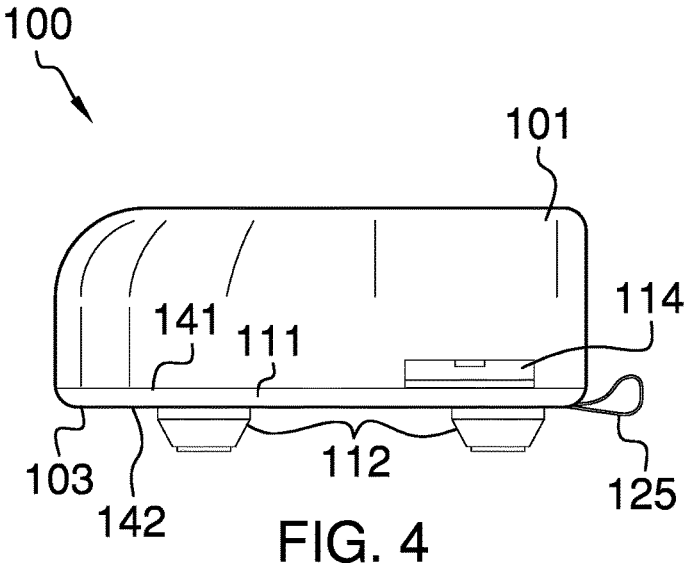
FIG. 4 is a side view of an embodiment of the disclosure.
Figure 5:
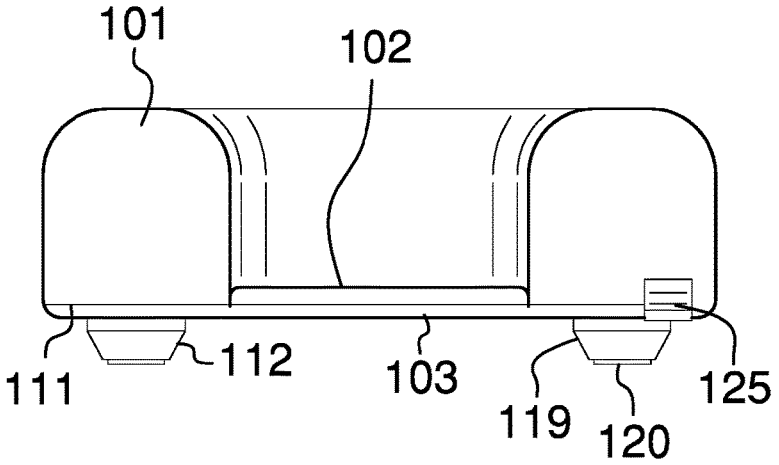
FIG. 5 is a front view of an embodiment of the disclosure.
Figure 6:
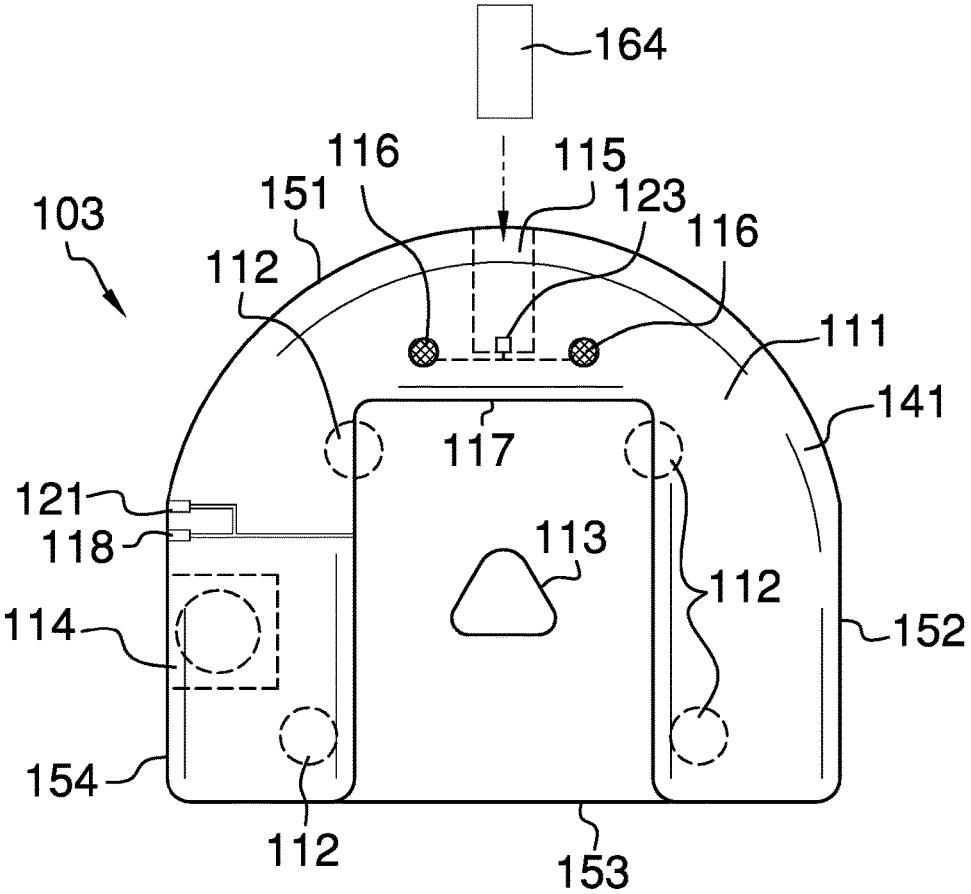
FIG. 6 is a detail view of an embodiment of the disclosure.
Figure 7:
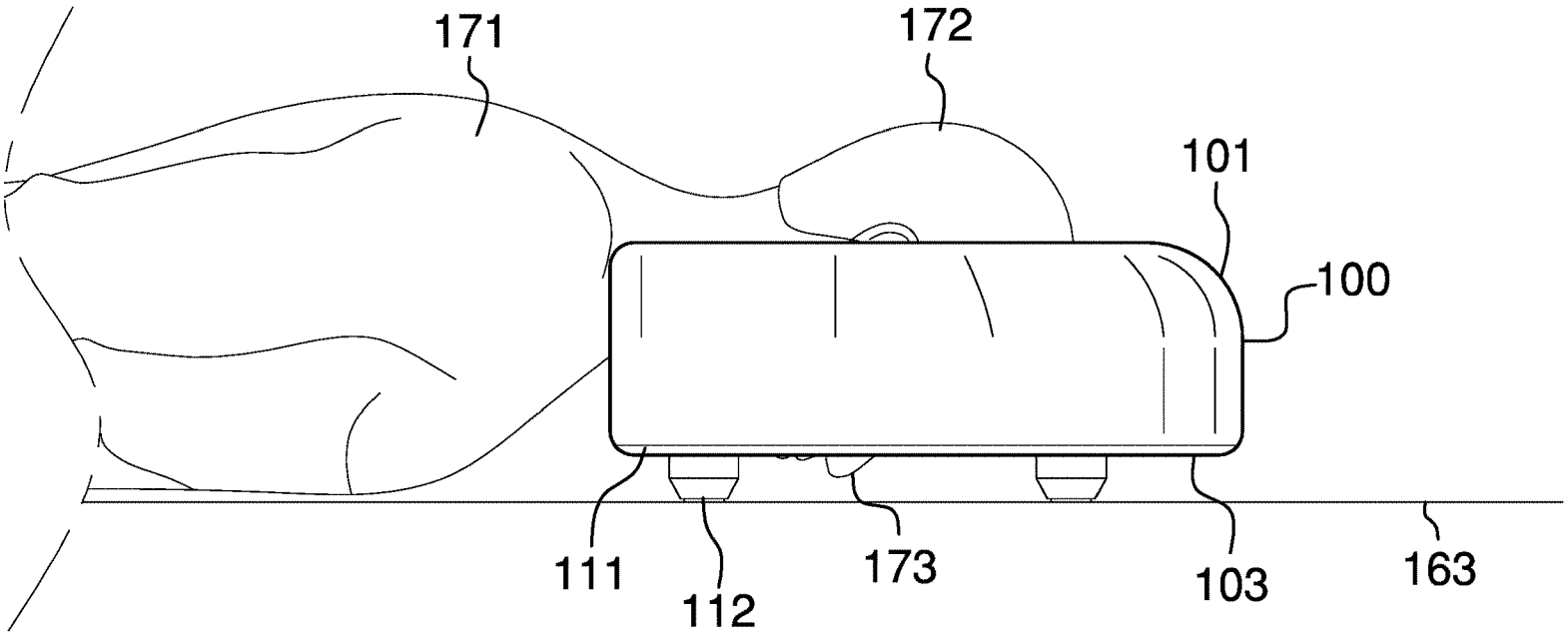
FIG. 7 is an in use view of an embodiment of the disclosure.

As shown most clearly in FIGS. 4, 5, and 6, the base 103 comprises a plate 111, a plurality of feet 112, and a first aperture 113. The plate 111 is a rectangular plate structure that is formed with two rounded corners 122. The plate 111 is further defined by a first edge 151, a second edge 152, a third edge 153, a fourth edge 154, a first surface 141, and a second surface 142. The first edge 151 connects the two rounded corners 122. When directly viewing the first surface 141, the remaining edges are, in clockwise order, the second edge 152, the third edge 153 and the fourth edge 154. The second surface 142 is the surface that is distal from the first surface 141. The plurality of feet 112 are a collection legs that are mounted in the second surface 142 of the plate 111. The plurality of feet 112 project perpendicularly out of the second surface 142 such that the plurality of feet 112 raise the invention 100 above the horizontal 161 surface 163. Each of the plurality of feet 112 comprises a pedestal 119 and a non-skid material 120.

The pedestal 119 is a structure attaches to the second surface 142 of the plate 111 such that the pedestal 119 physically raises the plate 111 vertically 162. The non-skid material 120 is a commercially available material, often called a non-skid pad, which attaches to the end of the pedestal 119 that is distal from the plate 111. The non-skid material 120 prevents the invention 100 from shifting while being supported on a horizontal 161 surface 163. The first aperture 113 is an opening formed through the plate 111 from the first surface 141 through to the second surface 142. The purpose of the first aperture 113 is to form a space into which the nose and mouth 173 of a user 171 may be positioned such that the user 171 may breathe comfortably while using the invention 100. The loop 125 is a structure that allows the invention 100 to be attached to a carabiner for transport.

The first pad 101 is a cushion upon which the head 172 rests when the invention 100 is used. As shown most clearly in FIG. 1, the first pad 101 mounts on the first surface 141 of the plate 111. The first pad 101 is attached such that the first pad 101 follows the contour formed by the section of the perimeter of the plate 111 defined by the fourth edge 154, the first edge 151, and the second edge 152. As shown most clearly in FIGS. 1 and 5, the first pad 101 is formed in a semi-cylindrical shape that is bent around the perimeter section to form a U shape. The first pad 101 attaches to the plate 111 using an adhesive. In the first potential embodiment of the disclosure, the first pad 101 is a commercially available cushion that comprises a polyurethane foam padding material.

The second pad 102 is a cushion upon which the head 172 rests when the invention 100 is used. As shown most clearly in FIG. 1, the second pad 102 mounts on the first surface 141 of the plate 111. The second pad 102 is a ring structure that is further defined with a second aperture 124. The second pad 102 is formed such that: 1) the second pad 102 can be positioned on the plate 111 such that the second pad 102 will fit within the interior space formed by the first pad 101; and, 2) the second aperture 124 of the second pad 102 will align with the first aperture 113 of the plate 111 such that the nose and mouth 173 of a user 171 fits through the first aperture 113 and the second aperture 124. Methods to form a cushion as described in this paragraph are well known and documented in the textile arts. The second pad 102 attaches to the plate 111 using an adhesive. In the first potential embodiment of the disclosure, the second pad 102 comprises a polyurethane foam padding material.

In a second potential embodiment of the disclosure, the plate 111 further comprises a heating element 117 a port 118, and a switch 121. The port 118 and the switch 121 are electrically connected to the heating element 117 in a manner that provides and controls the flow of electricity to the heating element 117. The purpose of the heating element 117 is to heat the first pad 101 and the second pad 102 for the comfort of the user 171. As shown most clearly in FIG. 6, the heating element 117 is a commercially available heating element 117 that mounts on first surface 141 of the plate 111. The port 118 is a commercially available port 118 that attaches to an externally provided plug that connects the port 118 to an external source of electricity. The switch 121 is a commercially available switch 121 that turns the heating element 117 on or off. Methods to fabricate the electrical connections described in this paragraph are well known and documented in the electrical arts. The heating element 117 the port 118, and the switch 121 attach to the plate 111 such that the heating element 117 the port 118, and the switch 121 are between the first surface 141 and one or more pads selected from the group consisting of the first pad 101 or the second pad 102. The plate 111 further comprises a loop 125.

In a third potential embodiment of the disclosure, the plate 111 further comprises a compartment 115, a PDD plug 123, and a plurality of speakers 116. The compartment 115 is a container that mounts on the first surface 141 of the plate 111 for the purpose of receiving a personal data device 164. The compartment 115 has further formed in it the PDD plug 123 that inserts into a port provided by the personal data device 164 to create an electrical connection with the personal data device 164. The plurality of speakers 116 comprises a collection of readily and commercially available speakers that are electrically connected to the PDD plug 123 such that audio signals generated by the personal data device 164 are transmitted to the plurality of speakers 116 in a manner that creates audible sounds. Methods to connect an external plurality of speakers 116 to a personal data device 164 are well known and documented in the electrical arts. The compartment 115, the PDD plug 123, and the plurality of speakers 116 attach to the plate 111 such that the compartment 115, the plug PDD 123, and the plurality of speakers 116 are between the first surface 141 and one or more pads selected from the group consisting of the first pad 101 or the second pad 102.

In a fourth potential embodiment of the disclosure, the plate 111 further comprises a cup holder 114. The purpose of the cup holder 114 is to secure a cup in such a manner such that the user 171 will not inadvertently move the cup. In the fourth potential embodiment, the cup holder 114 is a commercially available retractable cup holder assembly that is commonly sold as a replacement part for automobiles. The cup holder 114 attaches to a surface of the plate 111 selected from the group consisting of the first surface 141 or the second surface 142. The cup holder 114 attaches to the plate 111 such that the cup holder 114 is between the first surface 141 and one or more pads selected from the group consisting of the first pad 101 or the second pad 102.

To use the invention 100, the plurality of feet 112 are placed on a horizontal 161 surface 163. The user 171 lies face down on the horizontal 161 surface 163 and places their head 172 on the first pad 101 and the second pad 102 such that the nose and mouth 173 fit into the second aperture 124 and the first aperture 113.

The following definitions were used in this disclosure:

Carabiner: As used in this disclosure, a carabiner is a coupling link that is usually formed as an oblong metal ring with one spring hinged side that is used to open and close the ring. Synonyms for carabiner include D-link.

Heating Element: As used in this disclosure, a heating element is a resistive wire that is used to convert electrical energy into heat. Common metal combinations used to form heat elements include a combination of nickel and Chromium (typical: 80/20), a combination of iron, chromium and aluminum (typical 70/25/5), a combination of copper, nickel, iron, and manganese (typical 66/30/2/2) (use for continuously hot), or platinum.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Non-Skid Material: As used in this disclosure, a non-skid material is a commercially available product that can be applied to an object such that the object is inhibited from sliding along the surface upon which the object is resting. Non-skid materials are often, but not always, adhesive or abrasive materials.

Pad: As used in this disclosure, a pad is a mass of soft material used as a filling or for protection against damage or injury. Commonly used padding materials include, but are not limited to, polyurethane foam, a polyester fill often referred to as fiberfill or polystyrene beads often referred to as stuffing beans or as bean bag chair beans.

PDD: As used in this disclosure, PDD is an acronym for personal data device.

Perimeter: As used in this disclosure, a perimeter is one or more curved or straight lines that bounds an enclosed area on a plane or surface. The perimeter of a circle is commonly referred to as a circumference.

Personal Data Device: As used in this disclosure, a personal data device is a handheld device that is used for managing personal information and communication. Examples of personal data device include, but are not limited to, cellular phones, tablets and smart phones.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal.

Port: As used in this disclosure, a port is an electrical termination that is used to connect a first electrical circuit to a second external electrical circuit. In this disclosure, the port is designed to receive a plug.

Ring: As used in this disclosure, a ring is term that is used to describe a flat or plate like structure through which an aperture is formed.

Speaker: As used in this disclosure, a speaker is an electrical device that converts an electrical signal into an audible sound.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A headrest comprising:

a base, a first pad, and a second pad;

wherein the first pad and the second pad are mounted on the base;

wherein the headrest is a table top pillow;

wherein the headrest is self-supporting structure;

wherein the headrest is configured to support a head, a nose, and a mouth of a user;

wherein the headrest is configured to support the head of the user in such a manner that the head of the user may lie face down in the headrest;

wherein the headrest is used on a horizontal surface;

wherein the headrest incorporates passages that allows for breathing while lying face down;

wherein the base comprises a plate, a plurality of feet, and a first aperture;

wherein the plate is a rectangular plate structure;

wherein the plate is further defined by a first edge, a second edge, a third edge, a fourth edge, a first surface, and a second surface;

wherein the second surface is the surface that is distal from the first surface;

wherein the plurality of feet project out of the second surface such that the plurality of feet raise the headrest above the horizontal surface;

wherein the first aperture is an opening formed through the plate from the first surface through to the second surface;

wherein each of the plurality of feet comprises a pedestal and a non-skid material;

wherein the pedestal is a structure attaches to the second surface of the plate such that the pedestal physically raises the plate vertically;

wherein the non-skid material attaches to the end of the pedestal that is distal from the plate;

wherein the first aperture is sized to receive the nose and mouth;

wherein the first pad is a cushion;

wherein the first pad mounts on the first surface of the plate;

wherein the second pad is a cushion;

wherein the second pad mounts on the first surface of the plate;

wherein the first pad is attached such that the first pad follows a contour formed by a section of a perimeter of the plate defined by the fourth edge, the first edge, and the second edge;

wherein the first pad is formed in a semi-cylindrical shape that is bent around a perimeter section to form a U shape;

wherein the first pad attaches to the plate using an adhesive;

wherein the second pad is a ring structure that is further defined with a second aperture;

wherein the second pad is positioned on the plate such that the second pad will fit within the interior space formed by the first pad;

wherein the second aperture of the second pad will align with the first aperture of the plate such that the nose and mouth of the user fits through the first aperture and the second aperture.

2. The headrest according to claim 1 wherein the plate further comprises a heating element a port, and a switch;

wherein the port and the switch are electrically connected to the heating element;

wherein the heating element mounts on first surface of the plate;

wherein the port attaches to an external source of electricity;

wherein the switch turns the heating element on and off.

3. The headrest according to claim 2 wherein the heating element the port, and the switch attach to the plate such that the heating element the port, and the switch are between the first surface and one or more pads selected from the group consisting of the first pad or the second pad.

4. The headrest according to claim 3 wherein the plate is formed with two rounded corners;

wherein the plate further comprises a loop structure.

5. The headrest according to claim 1 wherein the plate further comprises a compartment, a PDD plug, and a plurality of speakers;

wherein the compartment is a container that mounts on the first surface of the plate;

wherein the container is sized to receive a personal data device;

wherein the personal data device further comprises a PDD port;

wherein the PDD plug mounts in the container;

wherein the PDD plug inserts into the PDD port.

6. The headrest according to claim 5 wherein the plurality of speakers are electrically connected to the PDD plug such that audio signals generated by the personal data device are transmitted to the plurality of speakers in a manner that creates audible sounds.

7. The headrest according to claim 6 wherein the compartment, the PDD plug, and the plurality of speakers attach to the plate such that the compartment, the plug PDD, and the plurality of speakers are between the first surface and one or more pads selected from the group consisting of the first pad or the second pad.

8. The headrest according to claim 7 wherein the plate is formed with two rounded corners;

wherein the plate further comprises a loop structure.

9. The headrest according to claim 1 wherein the plate further comprises a retractable cup holder assembly;

wherein retractable cup holder assembly attaches to the plate.

10. The headrest according to claim 9 wherein the plate is formed with two rounded corners;

wherein the plate further comprises a loop structure.

11. The headrest according to claim 3 wherein the plate further comprises a compartment, a PDD plug, and a plurality of speakers;

wherein the compartment is a container that mounts on the first surface of the plate;

wherein the container is sized to receive a personal data device;

wherein the personal data device further comprises a PDD port;

wherein the PDD plug mounts in the container;

wherein the PDD plug inserts into the PDD port;

wherein the plurality of speakers are electrically connected to the PDD plug such that audio signals generated by the personal data device are transmitted to the plurality of speakers in a manner that creates audible sounds;

wherein the compartment, the PDD plug, and the plurality of speakers attach to the plate such that the compartment, the plug PDD, and the plurality of speakers are between the first surface and one or more pads selected from the group consisting of the first pad or the second pad.

12. The headrest according to claim 11 wherein the plate further comprises a retractable cup holder assembly;

wherein retractable cup holder assembly attaches to the plate.

13. The headrest according to claim 12 wherein the plate is formed with two rounded corners;

wherein the plate further comprises a loop structure.

* * * * *